United States Patent [19]

Korski et al.

[11] Patent Number: 4,845,794

[45] Date of Patent: Jul. 11, 1989

[54] APPARATUS FOR WET CLEANING A FLOOR OR WALL SURFACE

[75] Inventors: Henryk Korski, Herley; Jerzy Korski, Bagsvaerd, both of Denmark

[73] Assignee: Rotowash Scandinavia, Herley, Denmark

[21] Appl. No.: 271,342

[22] Filed: Nov. 10, 1988

Related U.S. Application Data

[63] Continuation of Ser. No. 176,104, Mar. 31, 1988, abandoned.

[30] Foreign Application Priority Data

Apr. 3, 1987 [DK] Denmark ..... 1720/87

[51] Int. Cl.[4] ..... A47L 11/282

[52] U.S. Cl. ..... 15/51; 15/320; 15/353

[58] Field of Search ..... 15/51, 320, 321, 353

[56] References Cited

U.S. PATENT DOCUMENTS

| | | | |
|---|---|---|---|
| 1,268,963 | 6/1918 | Gray | 15/320 |
| 1,296,868 | 3/1919 | Smith | 15/320 X |
| 1,310,296 | 7/1919 | Rogers et al. | 15/51 |
| 1,333,226 | 3/1920 | Stoney | 15/51 |
| 1,506,016 | 8/1924 | Lundgren | 15/320 X |
| 2,043,878 | 6/1936 | Babbs | 15/51 |
| 2,680,260 | 6/1954 | Danielsson et al. | 15/50 R |
| 3,117,337 | 1/1964 | Krammes | 15/320 |
| 3,686,707 | 8/1972 | Highes et al. | 15/385 |
| 4,369,544 | 1/1983 | Parisi | 15/320 |
| 4,433,451 | 2/1984 | Parisi | 15/322 X |

FOREIGN PATENT DOCUMENTS

| | | |
|---|---|---|
| 303981 | 12/1954 | Czechoslovakia . |
| 0017519 | 10/1980 | European Pat. Off. . |
| 1149145 | 5/1963 | Fed. Rep. of Germany . |
| 1503864 | 3/1970 | Fed. Rep. of Germany . |
| 2206281 | 8/1973 | Fed. Rep. of Germany . |
| 2722653 | 11/1978 | Fed. Rep. of Germany . |
| 2244439 | 4/1975 | France . |

*Primary Examiner*—Chris K. Moore

*Attorney, Agent, or Firm*—Merchant, Gould, Smith, Edell, Welter & Schmidt

[57] ABSTRACT

An apparatus for wet cleaning floor or wall surfaces comprises one or more cylindrical brushes which may be rotated by a motor so that they are throwing liquid and dirt from the floor or wall surface on to a rotating cylinder or a moving endless belt. Liquid and dirt is continuously removed from the outer peripheral surface of the cylinder or belt by means of a suction nozzle extending along the axial length of the cylinder and immediately adjacent to the peripheral surface thereof. The suction nozzle may have a lower edge functioning as a scraping member which is in contact with the peripheral surface of a cylinder. Liquid and dirt removed from the cylinder by means of the suction nozzle is passed to a container for collecting dirty liquid.

14 Claims, 2 Drawing Sheets

Fig. 2
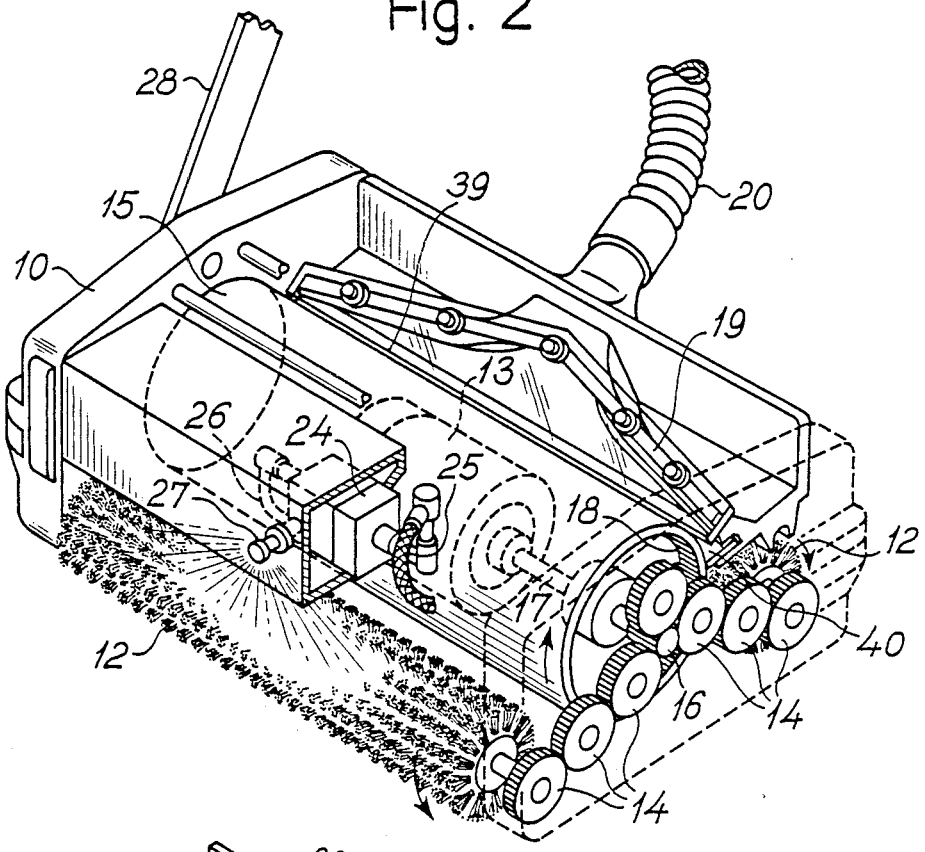
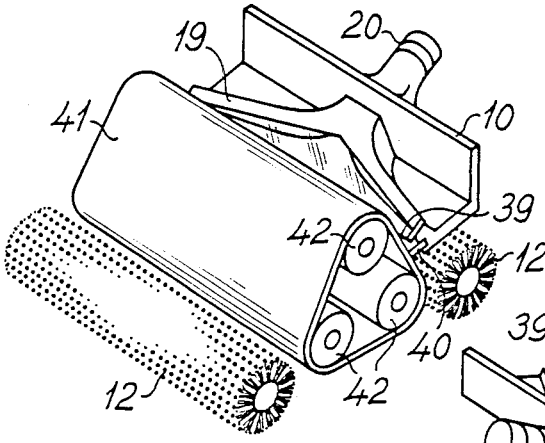
Fig. 3
Fig. 4
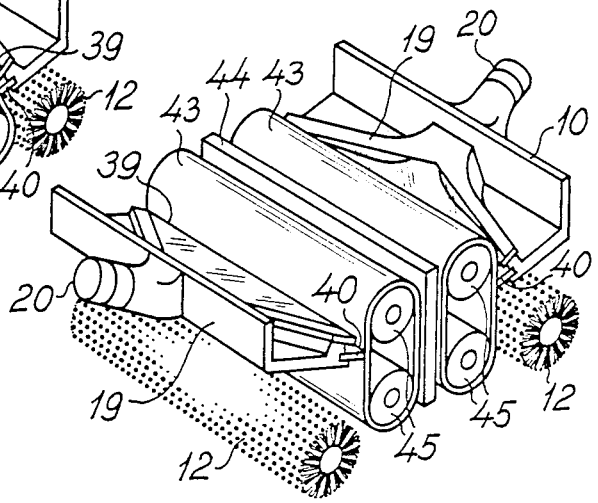

APPARATUS FOR WET CLEANING A FLOOR OR WALL SURFACE

This is a continuation, of application Ser. No. 176,104, filed, Mar. 31, 1988, abandoned.

FIELD OF THE INVENTION

The invention relates to an apparatus for wet cleaning a floor or wall surface.

DESCRIPTION OF THE PRIOR ART

German Ausiegeschrift No. 1,149,145 discloses a floor washing apparatus comprising a rotatable brush which is in contact with the floor to be cleaned, and a rotating cylinder or drum, whichis arranged out of engagement with the floor and in such a position that the rotating brush may throw dirt and liquid which has been spread over the floor from the floor surface on to the outer peripheral surface of the rotating cylinder or drum. A scraper is positioned in engagement with the peripheral drum surface so as to remove liquid and dirt therefrom and pass it to a collecting container for dirty liquid.

In the known apparatus the scraping member used for removing liquid and dirt from the cylinder or drum is exposed to relatively heavy wear because of particles of sand and other hard materials present in the dirt collected. Furthermore, if a too much water or washing liquid is applied to the floor surface to be cleaned, dirty liquid tends to drip or flow from the ends of the scraping member back on to the floor surface.

SUMMARY OF THE INVENTION

The present invention provides an improvement of a cleaning apparatus of the above type which may be used for treating very dirty and/or wet floor or wall surfaces, and which does not involve wearing and liquid spillage problems in connection with the transfer of dirt and washing liquid from the cylinder or drum to the container for collecting dirty liquid.

Thus, the present invention provides an apparatus for wet cleaning a floor or wall surface, said apparatus comprising a liquid collecting member defining a movable endless liquid collecting surface thereon, motor-driven rotatable brushing means for contacting said floor or wall surface so as to throw dirty washing liquid therefrom on to said liquid collecting surface, a liquid container for collecting dirty washing liquid therein, and transfer means for transferring liquid from the collecting surface to the container, said transfer means including a suction nozzle communicating with the liquid container and being arranged immediately adjacent to the liquid collecting surface so as to suck liquid therefrom.

Such a suction nozzle communicating with a suitable vacuum source may without any special wearing problems remove substantially all of the dirt and washing liquid thrown on to the liquid collecting member by the rotating brushing means. The brushing means are preferably of a type securing an efficient cleaning of the floor or wall surface when a suitable cleaning or washing liquid is present thereon. Thus, the brushing means may comprise one or more rotating cylindrical brushes. However, other kinds of brushing means which are able to throw liquid and dirt from a floor or wall surface on to the liquid collecting surface may also be used. The suction nozzle may be spaced from the liquid collecting surface at a small distance and may then efficiently remove even relatively big amounts of liquid and dirt from the liquid collecting surface without any liquid spillage tendency from the collecting surface at the ends of the suction nozzle. Furthermore, because the suction nozzle need not be in contacting engagement with the liquid collecting surface, wearing problems may be avoided.

The liquid collecting member may, for example, be a rotatable cylinder or a drum, or an endless belt. Liquid and dirt may be removed from the endless surface of the liquid collecting member by means of a scraping member as well as by one or more suction nozzles. As an example, suction nozzles may be arranged at the edges of the liquid collecting member, and a scraping member may be arranged between such suction nozzles. However, in a preferred embodiment according to the invention, the suctrion nozzles extends along the total dimension of the liquid collecting surface transversely to its direction of movement.

According to the invention, the suction nozzle may define a suction slot between a first edge member and a second edge member spaced therefrom in the direction of movement of the collecting surface and the second edge member may then be formed as a scraping or wiping member, which is in contact with the liquid collecting surface, and the first edge member may be arranged out of engagement with the collecting surface. The suction provided by the suction nozzle will remove the main part of liquid and dirt or slurry adhered to the liquid collecting surface when passing the first edge member of the suction nozzle. However, a possible residual amount will be scraped from the liquid collecting surface by the second edge member or scraping member and sucked into the nozzle.

The suction nozzle or nozzles may communicate with a liquid separator for separating liquid and dirt from the suction air. The separated liquid and dirt may then be passed to the liquid container, while the air flows to a vacuum source to which the suction nozzle is connected.

In the known apparatus described above where liquid and dirt is removed from a drum or cylinder exclusively by means of a scraping member, the cylinder or drum must have a substantially smooth peripheral surface. This fact puts a limitation on the amount of liquid and dirt which can adhere to the outer surface of the cylinder or drum. However, in the apparatus according to the invention where liquid and dirt is removed from the liquid collecting surface, such as the outer surface of a cylinder or endless belt, at least partly by suction, the liquid collecting surface may be rough or rugged. Thus, for example, the surface may be dimpled. This feature substantially increases the amount of liquid and dirt which may be transported by the liquid collecting surface so that the apparatus will become better suited for heavy duty work.

BRIEF DESCRIPTION OF THE DRAWINGS

The invention will now be further described with reference to the drawings, wherein FIG. 2 is a perspective view of the bottom part of the apparatus, certain wall parts and overlying parts having been cut away, and FIGS. 3 and 4 diagrammatically illustrate second and third embodiments of the apparatus according to the invention.

DESCRIPTION OF THE PREFERRED EMBODIMENT

Figure 1:
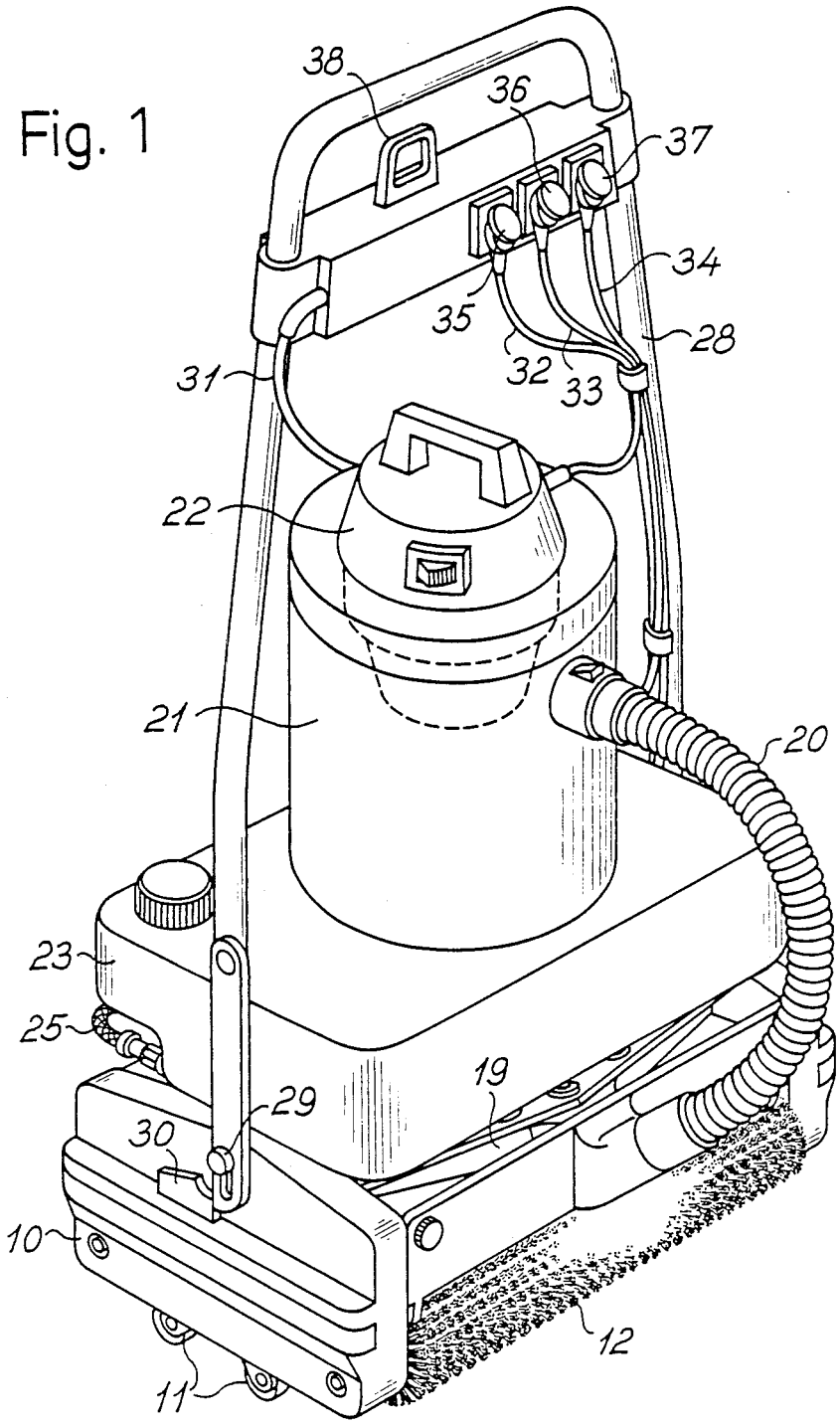
FIG. 1 is a perspective view of an embodiment of the apparatus according to the invention.

The apparatus shown in FIG. 1 and 2 comprises a frame 10 which may be supported by retractable transporting rollers 11 which are movable between an active transporting position shown in FIG. 1 and an inactive retracted position. A pair of transversely spaced cylindrical brushes 12 are rotatably mounted within the frame 10 so that the apparatus is supported by the rotatable brushes 12 when the transporting rollers are in their retracted position, while the brushes 12 are slightly spaced from the floor surface when the transporting rollers 11 are in their extended active position. The brushes 12 may be rotated in opposite directions (indicated by arrows in FIG. 2) by means of a driving motor 13 through trains of intermeshing gears 14. The motor 13 is arranged within the hollow space of a hollow drum or cylinder 15 extending parallel with and being arranged between the brushes 12 so that the outer surface of the cylinder 15 is radially spaced from the cylindrical brushes 12 as well as from the floor surface. A pinion 16 mounted on the driving shaft 17 of the motor 13 is in driving engagement not only with the gear trains 14 but also with a toothed inner rim 18 formed at one end of the hollow cylinder 15. The gear ratio between the driving shaft 17 and the rotatable brushes on one hand, and between the driving shaft 17 and the hollow cylinder 15 on the other hand is such that the cylinder 15 will move in the direction indicated by an arrow in FIG. 2 at a rotational speed which is much slower than the rotational speed of the brushes 12. A suction nozzle 19 is mounted in the frame 10 so that a narrow suction slot defined by the nozzle is positioned closely adjacent to the outer surface of the hollow cylinder 15 and extends along a generatrix in the total axial length of the cylinder. A flexible hose 20 connects the suction nozzle 19 to a container 21 for collecting dirty washing liquid, and vacuum may be provided within the container 21 by means of a motor operated suction unit 22 arranged at the top of the container 21 so that the container 21 also functions as a vacuum source.

A tank 23 for containing fresh washing liquid is supported on the top of the frame 10, and the container 21 is in turn supported by the top surface of the tank 23. A liquid discharge pump 24 communicates with the tank 23 through a flexible tube 25, and a pump outlet 26 is connected to a spraying nozzle 27 arranged in front of the forward rotating brush 12.

A bifurcated handle 28 is swingably mounted on the frame 10 by means of pin-slot connections 29, and the lower ends of the handle 28 may cooperate with a cam member 30 formed on the frame 10 so that the handle may be placed in a substantially vertical storing position shown in FIG. 1 or in a tilted working position shown in FIG. 2. Power may be supplied to the apparatus through a power supply cable 31 and the suction unit 22, the liquid pump 24 and the driving motor 13 may then be energized through cables 32, 33 and 34, respectively. The operation of the suction unit 22, the liquid pump 24, and the driving motor 13 may be controlled by electrical contacts 35, 36, and 37, respectively. The amount of liquid sprayed by the spraying nozzle 27 may be controlled by a control handle 38.

In operation, the liquid pump 24 is energized whereby washing water or another washing liquid is sprayed from the nozzle 27 on to the floor surface to be cleaned in front of the rotating brushes 12. The driving motor 13 may now be energized so as to rotate the brushes 12 and the hollow cylinder 15. When the apparatus is moved over the sprayed area of the floor, the floor surface will be scrubbed and cleaned. The rotational movement of the brushes 12 in the directions indicated by arrows in FIG. 2 causes used washing liquid and dirt from the floor to be thrown on to the outer peripheral surface of the slowly rotating cylinder 15 and adhere thereto. The suction slot of the suction nozzle 19 is defined between an upper nozzle edge 39 which is slightly radially spaced from the adjacent outer surface of the cylinder 15, and a lower scraping member 40. The scraping member 40, which is preferably made from a flexible material, such as rubber or plastic, is in contact with the outer peripheral surface of the cylinder 15.

During rotation of the cylinder 15, the layer of liquid and dirt adhered to the outer peripheral surface of the cylinder is continuously moved into the spacing between that peripheral surface and the upper nozzle edge 39, whereby liquid and dirt are sucked from the peripheral surface of the cylinder 15 into the suction nozzle 19 and further into the container 21 via the hose 20. Possible residual liquid adhering to the cylinder 15 is scraped from the cylinder by the scraping member 40 and sucked into the suction nozzle. In order to improve the adherence of water and dirt to the cylinder 15, the outer peripheral surface thereof may be dimpled or roughened in any suitable manner so as to improve the adherence of liquid thereto.

In the embodiment shown in FIG. 3, the cylinder 15 has been replaced by an endless belt 41 supported by three rollers 42 arranged in a triangular configuration. The scraping member 40 of the suction nozzle 19 is then arranged in contact with the outer peripheral surface of the endless belt 41.

In the embodiment shown in FIG. 4 two parallel endless belts separated by a separating wall 44 are used. Each of the belts 43 are passed around a pair of parallel, radially spaced supporting rollers 45, and a suction nozzle 19 is associated with each belt 43 as shown in FIG. 4.

It should be understood that various amendments of the embodiments shown in the drawings could be made within the scope of the present invention. As an example, the suction nozzle 19 could be replaced by two shorter suction nozzles arranged at opposite ends of the hollow cylinder 15 or the belts 41 or 43, and a scraping device for scraping liquid from the cylinder or belt and for passing such liquid to a liquid collecting container could be arranged between the suction nozzles. Although it is preferred to use a pair of parallel rotating brushes, it would also be possible to use a single brushing device or three or more cooperating brushing devices.

We claim:

1. An apparatus for wet cleaning a floor surface, said apparatus comprising a liquid collecting member defining a movable endless liquid collecting surface thereon, motordriven rotatable brushing means for contacting said floor or wall surface so as to throw dirty washing liquid therefrom on to said liquid collecting surface, a liquid container for collecting dirty washing liquid therein, and transfer means for transferring liquid from the collecting surface to the container, said transfer means including a suction nozzle communicating with the liquid container and being arranged immediately adjacent to the liquid collecting surface so as to suck liquid therefrom.

2. An apparatus according to claim 1, wherein the liquid collecting member comprises a rotatable cylinder.

3. An apparatus according to claim 1, wherein the liquid collecting member comprises an endless belt.

4. An apparatus according to claim 1, wherein the suction nozzle extends along substantially the total dimension of the liquid collecting surface transversely to its direction of movement.

5. An apparatus according to claim 1, wherein the suction nozzle defines a suction slot between a first edge member and a second edge member spaced therefrom in the direction of movement of the collecting surface, the second edge member being formed as a scraping member, which is in contact with the liquid collecting surface and the first edge member being arranged out of engagement with the liquid collecting surface.

6. An apparatus according to claim 5, wherein said second edge member is made from a flexible material.

7. An apparatus according to claim 1, wherein the liquid collecting surface is roughened so as to improve the adherence of liquid thereto.

8. An apparatus according to claim 7, wherein the liquid collecting surface is dimpled.

9. An apparatus for wet cleaning a floor surface, said apparatus comprising a tank for clean washing liquid, means for dispensing liquid from said tank on to the floor surface, a liquid collecting rotatable, cylinder defining a liquid collecting outer cylindrical surface thereon, motor-driven rotatable brushing means for contacting said floor surface so as to throw dirty washing liquid therefrom on to said liquid collecting surface, a liquid container for collecting dirty washing liquid therein, transfer means for transferring liquid from the collecting surface to the container, said transfer means including a suction nozzle communicating with the liquid container and being arranged immediately adjacent to the liquid collecting surface so as to suck liquid therefrom.

10. An apparatus according to claim 9, wherein the suction nozzle extends along substantially the total length of the cylindrical liquid collecting surface.

11. An apparatus according to claim 9, wherein the suction nozzle defines a suction slot between a first edge member and a second edge member spaced therefrom in the direction of rotation of the cylinder, the second edge member being formed as a scraping member, which is in contact with the cylindrical liquid collecting surface, and the first edge member being arranged out of engagement with the liquid collecting surface.

12. An apparatus according to claim 9, wherein said edge member is made from a flexible material.

13. An apparatus according to claim 12, wherein the liquid collecting surface is roughened so as to improve the adherence of liquid thereto.

14. An apparatus according to claim 13, wherein the liquid collecting surface is dimpled.

* * * * *

UNITED STATES PATENT AND TRADEMARK OFFICE

CERTIFICATE OF CORRECTION

PATENT NO. : 4,845,794

DATED : 11 July 1989

INVENTOR(S) : Henryk Korski, Jerzy Korski

It is certified that error appears in the above-identified patent and that said Letters Patent is hereby corrected as shown below:

On the title page, under "Foreign Patent Documents", "Czechoslovakia" should be --Switzerland--.

Signed and Sealed this

Twenty-third Day of July, 1991

*Attest:*

HARRY F. MANBECK, JR.

*Attesting Officer*

*Commissioner of Patents and Trademarks*